US009322534B2

(12) United States Patent
Curic

(10) Patent No.: US 9,322,534 B2
(45) Date of Patent: Apr. 26, 2016

(54) CEILING ILLUMINATION WITH MOUNTINGS FOR PANELS

(71) Applicant: Novomatic AG, Gumpoldskirchen (AT)

(72) Inventor: Andrija Curic, Vienna (AT)

(73) Assignee: Novomatic A.G., Gumpoldskirchen (AT)

( * ) Notice: Subject to any disclaimer, the term of this patent is extended or adjusted under 35 U.S.C. 154(b) by 214 days.

(21) Appl. No.: 14/097,725

(22) Filed: Dec. 5, 2013

(65) Prior Publication Data

US 2014/0092610 A1 Apr. 3, 2014

Related U.S. Application Data

(63) Continuation of application No. PCT/EP2012/002407, filed on Jun. 6, 2012.

(30) Foreign Application Priority Data

Jun. 10, 2011 (DE) ..... 20 2011 101 714 U

(51) Int. Cl.

| | |
|---|---|
| ***F21V 21/03*** | (2006.01) |
| ***F21S 2/00*** | (2006.01) |
| ***F21S 8/06*** | (2006.01) |

(Continued)

(52) U.S. Cl.

CPC . *F21V 21/03* (2013.01); *E04B 9/32* (2013.01); *F21S 2/005* (2013.01); *F21S 8/061* (2013.01); *F21S 8/063* (2013.01); *F21V 7/0091* (2013.01); *F21V 17/10* (2013.01); *G07F 17/3216* (2013.01); *F21V 2200/00* (2015.01)

(58) Field of Classification Search

CPC ..... E04B 9/32; E04B 9/006; E04B 9/34; F21V 21/049; F21V 5/00; F21V 21/03; F21V 21/041; F21V 21/048; F21S 8/04; F21S 2/005; F21S 8/06; F21Y 2103/00; Y10S 362/806; Y10T 24/344; G07F 17/3216

USPC ..... 362/145–147, 367, 404–406, 408; 52/171.3

See application file for complete search history.

(56) References Cited

U.S. PATENT DOCUMENTS 3,308,288 A * 3/1967 Ades ..... E04B 9/006 362/150
3,471,981 A * 10/1969 Segil ..... E04B 9/064 362/150

(Continued)

FOREIGN PATENT DOCUMENTS

GB 849847 A * 9/1960 ..... E04B 9/122

*Primary Examiner* — Hargobind S Sawhney
(74) *Attorney, Agent, or Firm* — Kevin H. Fortin

(57) ABSTRACT

An illuminating device for indoor lighting comprising a visible panel, through which light can be transmitted. The visible panel includes a portion having transparent material, and a panel retaining device. The retaining device has a retaining means for retaining the visible panel and a fixing means for mounting the visible panel on a ceiling or on a wall. The retaining device has at least three interconnected retaining arms which are arranged in the shape of a star and which retain at least two visible panel parts at the inner faces of the visible panel parts, the inner faces of the visible panel parts bordering each other such that said visible panel parts together form a substantially continuous visible panel surface. The visible panel parts have free outer faces which are not retained by the retaining arms and which together from the outer circumference of the visible panel.

18 Claims, 5 Drawing Sheets

(51) Int. Cl.

| | |
|---|---|
| ***F21V 7/00*** | (2006.01) |
| ***F21V 17/10*** | (2006.01) |
| ***E04B 9/32*** | (2006.01) |
| ***G07F 17/32*** | (2006.01) |

(56) References Cited

U.S. PATENT DOCUMENTS 4,263,639 A * 4/1981 Schacht ..... E04B 9/32
362/147

4,835,916 A * 6/1989 Steadman ..... E04B 9/30
52/28

5,609,007 A * 3/1997 Eichner ..... E04B 9/064
52/506.07

7,021,011 B2 * 4/2006 Mian ..... F21V 5/00
40/541

7,481,550 B1 * 1/2009 Schreiber ..... E04B 9/32
362/148

7,510,297 B2 * 3/2009 Dobija ..... F21S 2/00
362/147

* cited by examiner

CEILING ILLUMINATION WITH MOUNTINGS FOR PANELS

CROSS-REFERENCE TO RELATED APPLICATIONS

This patent application is a continuation of International Patent Application No. PCT/EP2012/002407, filed on 6 Jun. 2012, which claims priority to German Patent Application No. 202011101714.5, filed on 10 Jun. 2011, these related applications are incorporated herein by reference.

FIELD OF THE INVENTION

The present invention relates to indoor lighting devices and in particular to devices for illuminating a gaming machine island.

BACKGROUND AND SUMMARY OF THE INVENTION

The present invention refers to an illuminating device for the illumination of a region of a room, in particular an illumination of gaming machine island, with a view-panel of at least partly transparent material through which light can be transmitted, as well as a panel retaining device, which features retaining means for the retention of the view-panels and fixing means for mounting the view-panel on the ceiling and the wall.

In large capacity situations, i.e. extensive premises not divided by walls it is desirable to illuminate in an accentuated manner individual sub-areas of such large capacities for the facilitation of orientation of the visitors and to emphasise these vis-á-vis other regions of a room. Such large capacity situations are given, for example in casinos and gambling halls, in which occasionally groups of gaming machines are concentrated to so-called gaming machine islands, which respectively offer, for example, a comparable type of game and can therefore form a game theme island. The corresponding gaming machine islands are to be emphasised on the one hand vis-á-vis open space or aisles, which are located between the gaming machine islands, on the other hand the corresponding gaming machines are to be emerged in an atmospherically fitting light, for example a dramatic lighting situation for gaming machines promising suspense or happy, friendly light for the entertainment games, etc.

In order to hereby guarantee the visibility of gaming machines often equipped with screens and to facilitate an operation of the gaming machines which is fatigue-proof for the eyes it is desirable to have at least a reasonably constant luminosity distribution while simultaneously providing freedom from glare. Hereto it is advantageous if the illuminating device, which usually is installed above the gaming machine island due to the architectural spatial conditions, comprises an extensive view-panel, which, evenly luminescent, emits the light into the desired region of the room. A sufficient extensiveness facilitates hereby sufficient luminosity also with relatively low light density, which facilitates a well perceivable accentuation of the corresponding region of the room while simultaneously providing freedom from glare.

Such extensive, light-emitting or trans-illuminable view-panels are, however, not to be installed without further ado in the respective premises, in particular if the installation occurs subsequently with already existing ceiling constructions and already positioned devices or exhibits in the region of the room to be illuminated. For example, in gaming casinos or gambling halls ceiling lighting, for example in form of spotlights or fluorescent tubes, often already exists and on the corresponding gaming machine islands gaming machines are installed so that with subsequent assembly the existing ceiling construction and their dimensions are to be used. The already positioned gaming machines may not be polluted or removed, wherein larger alterations at the ceiling construction are forbidden and larger lifting devices for the raising of larger illuminating devices for the assembly on the ceiling can hardly be used.

The object of the present invention is to create an improved illuminating device of the above-mentioned kind that avoids the disadvantages of the state-of-the-art technology and further develops the latter advantageously. In particular, an illuminating device to be easily assembled subsequently even with a given spatial construction is to be created, which with a clear accentuation of the allocated region of the room facilitates good visibility and fatigue-proof operation or observation of the devices or exhibits there displayed and which is individually adjusted to different accentuation requests.

According to invention the mentioned object is solved by an illuminating device in accordance with claim 1, as filed. Preferred embodiments of the invention are subject of the dependent claims. In particular, the illuminating device for the illumination of a gaming machine island in accordance with claim 14 can be applied.

It is therefore recommended that the view-panel, through which light can be transmitted, is to be composed of multiple view-panel parts and the view-panel parts are to be fastened by a spider-like retaining arm structure, which retains the view-panels at their adjacent inner faces. The weight forces of the view-panel parts are absorbed inside or by the spider-like retaining arm structure of the view-panels so that even with extensive view-panels only limited bending moments act on the view-panel parts, which in turn allows the use of thin view-panel parts and renders the use of high-strength materials superfluous.

According to invention the retaining means of the panel retaining device have at least three interconnected retaining arms allocated in a star-shaped manner, which retain at least two view-panel parts on their inner faces, which are adjacent to the mentioned view-panel parts, so that the view-panel parts together form an essentially continuous view-panel surface, wherein the view-panel parts have free outer faces which are not retained by the retaining arms and which free outer faces together form the external circumference of the view-panel.

By the juxtaposition of several view-panel parts not only the desired extensiveness of the view-panels can be achieved with simultaneous graceful appearance, but also a modular design, which allows single view-panel parts to be interchanged and the variable compatibility of different view-panel parts. Hereby with a limited number of different view-panel parts many different view-panel surfaces and hereby many different light atmospheres can be created.

Simultaneously the central force transmission on the inner faces of the view-panel parts and the hereby resulting low bending loads allow the usage of cheaper view-panel material adapted to the lighting task with higher transparency and brilliancy, which also can achieve sufficient luminosity in the room to be illuminated with low power of the used illuminants. Alternatively additional retaining and retaining elements arranged in a punctiform or invasive manner can be foreseen, for example in the respective centre of mass or the centre of an area of one or every view-panel part.

Thereby the retaining arms can extend exclusively in the inside or in an internal area of the view-panel, wherein the view-panel parts may have free outer faces not retained by the retaining arms, which jointly form the external circumference. The view-panel parts can be supported alone on their internal view-panel edges facing each other, while the external view-panel edges forming the outer edge of the view-panel are designed in a self-supporting or unsupported manner or protrude. Such a design of the view-panel, which is not bound or bind-free at the external circumference, facilitates on the one hand with light, lucid appearance of the view-panel a shadow-free, at the intersection soft room illumination, while on the other hand also the interchangeability and easy assembly of the illuminating device are improved. Because of the lack of retaining elements on the external circumference sides the view-panel parts can be easily exchanged or assembled, in particular fixated to the retaining arms through the external circumference side or placed in the retaining device.

An improved weight support also with larger view-panels can be achieved with a further development of the invention by a partition of the view-panel in a sufficient number of view-panel parts and/or a corresponding large number of retaining arms. In principle the number of retaining arms and the number of view-panel parts can vary, wherein in a further advantageous embodiment of the invention between three and ten retaining arms and/or between three and ten view-panel parts are foreseen. In order to prevent on the one hand a multiplication of the assembly steps, but to achieve on the other hand a sufficient support effect with extensive view-panels, three to six, in particular four retaining arms can be foreseen in the further advantageous embodiment of the invention, which retain three to six, in particular four view-panels.

In order to achieve easy assembly and interchangeability of the view-panel parts the retaining arms are designed and arranged in a further embodiment of the invention in such a manner that the view-panel parts are inserted into the area spanned by two neighbouring retaining arms through the external circumference and can be attached to the retaining arms through the external circumference. In particular, each two neighbouring retaining arms can delimit a view-panel sector, which becomes narrow at the joining section of the two neighbouring retaining arms and whose lateral sector edges are designed in direction of the mentioned joining section free of undercuts. Hereby it becomes possible that the respective view-panel part is inserted from the outside into the area section spanned by the two neighbouring retaining arms and to attach it to the retaining arms without the view-panel part jamming.

However, alternatively or additionally it can also be foreseen that the respective view-panel part is attached to the mentioned retaining arms from a lower side or, in particular, from an upper side. Hereby the mentioned undercut-free design of the retaining arms can be dispensed with. When inserting the view-panel parts diagonally or vertically to a level which is spanned by the retaining arms, the retaining arms can be arbitrarily contoured; in particular also arch-shaped curved or run in another form deviating from a straight course.

In a further advantageous embodiment the mentioned retaining arms can have at least approximately a straight course and can delimit each in pairs a V-shaped view-panel sector. The retaining arms delimit hereby the lateral legs running apart of the view-panel sector into which then a corresponding view-panel part can be inserted.

The anchoring of the view-panel parts at the mentioned retaining arms can be achieved hereby in principle in different ways and manners. In order to keep view-panel parts as much as possible tension-free and correspondingly to be able to use tension-sensitive materials for the view-panel parts, the retaining arms can have form-locked retaining elements, in particular in the form of retaining projections and/or retaining recesses, which encompass the respective view-panel part at its edges advantageously from at least two lateral sides. Alternatively or additionally also frictionally engaged, in particular clamping installation of the view-panels could be foreseen. In order to be able to use sensitive glass for the view-panel parts, however, the retaining arms are advantageously foreseen with tension-free holding, preferably form-locked retaining elements.

In particular the retaining arms can have open, preferably nut-shaped retaining recesses towards the opposite sides, so that from the opposite sides two view-panel parts lying back-to-back or lying narrow side to narrow side can be inserted into the view-panel recesses and can hereby be attached to the retaining arms lying between the retaining recesses. The mentioned retaining recesses can hereby be designed permanently in the sense of a continuous channel. Alternatively or additionally the mentioned retaining recesses can extend also only in sections, for example in the form of a multitude of retaining recesses spaced-apart, arranged in a grid pattern, hooks or support ribs on which the view-panel parts lie. The open profile shape of the retaining recesses can hereby in principle be contoured differently, wherein, for example, a retaining recess of a support profile can be designed in the cross-section in an L-shaped manner, on whose lying leg the respective view panel can lie.

In a further advantageous embodiment of the invention the retaining elements of the retaining arms are designed in such a manner that the view-panel parts are encompassed by the sides lying opposite. Hereby the view-panel parts are reliably supported and are secured from falling down. In particular the retaining arms can be designed in an extruded profile with an H-shaped cross-section. Hereby with a minimum distancing of view-panel parts adjacent to each other a safe retention of the view-panel parts can be achieved. Simultaneously, the retaining arms can be manufactured at low costs.

In order to mount the panel retaining device with view-panel parts attached thereto to a ceiling and/or a wall, if applicable also to a lamppost-like or pillar-bar-like holder part, the retaining arms have at their rear side facing away from the visible side of the view-panel allocated fixing means for the fixing of tie rods, which can be designed differently, for example in the form of flexible tie means such as ropes or chains, or in form of bend-proof tie rods such as poles or bars.

In order to achieve an easy adaption to the retaining device at different assembly situations and extension structures the retaining arms have advantageously each a multitude of allocated fixing means distributed in a grid-like manner for the fixing of tie rods for the wall or ceiling mounting. Through the multitude of differently positioned fixing means the corresponding tie rods can be fixed in dependence of predetermined fixing points, for example at a ceiling structure in a suitable manner and in a suitable position at the retaining arms.

The mentioned fixing means for the fixing of the tie rod to the mentioned retaining arms are advantageously designed in a detachable manner in order to be able to relocate the tie rod in a corresponding manner.

In order to facilitate a stable, tight mounting of the view-panel, also during vibrations or air draft, the panel fixing device comprises advantageously to the retaining arms tightly connectable, in particular rigidly connectable, support poles, so that the retaining arms together with the tie poles or support poles attached thereto form a stiff holding structure. For example, bend-proof tie poles can be fixed by stud connections rigidly, but also detachable to the retaining arms, wherein the mentioned stud connections can be foreseen at the non-visible side of the retaining arms.

In order to construct the panel retaining device in a modular manner and to be able to redesign it variably multiple retaining arms of the support holder device can be custom-made separately from each other and can be connected to each other with a joint cruciform fastening element. The retaining arms are hereto advantageously attached inflexibly to the mentioned fastening element, so that they protrude from the fastening element in a star-shaped manner or in a radially outward manner. With such a central fastening or connection element the retaining arms can be produced as off-the-peg products or as bulk stock, wherein then for the respective view-panel to be produced retaining arms in the desired length are deflected from the bulk stock. The central fastening element is hereby advantageously designed in such a manner that the retaining arms are allocated in a joint level, in particular in such a manner that the retaining recesses formed between two neighbouring retaining arms for a view-panel run pointedly towards each other at the mentioned fastening element.

The retaining arms can be attached at the mentioned cruciform fastening element in principle in different ways and manners, for example wielded. In order to prevent a delay during the manufacturing by thermal contamination the retaining arms can however also be screwed, riveted or assembled in another form in a form-locked and/or in a frictionally engaged manner.

The view-panel parts can be made in principle from different at least partly transparent, transilluminable materials, for example out of glass. In a further advantageous embodiment of the invention the view-panel parts can be made of plastic, for example polycarbonate.

In order to achieve an accentuated illumination of the allocated region of the room with simultaneous even luminosity distribution the view-panel parts can have a changing colouring or tarnishing in such a manner that different sections of the view-panel parts have different colours and/or different transparency degrees, wherein advantageously the intersections between the areas regarding colour scheme and transparency degree are designed in a soft and merging manner and no abrupt transparency degree changes or colour changes are foreseen.

The illuminants for the backlighting or trans-illumination of the view-panel can in principle be selected in a different manner and must not compulsorily be part of the construction group comprising the view-panel and the panel retaining device. For example, the view-panel with the panel retaining device can be superimposed in a simple manner by already existing illuminants, for example in the form of fluorescent tubes which are mounted on the ceiling, so that the view-panel is irradiated and transilluminated by conventional, already existing ceiling illumination.

Alternatively or additionally the illuminating device can however also comprise illuminants, which are attached to the panel retaining device and/or the view-panels. For example, the tie bars attached to the retaining arms can form simultaneously support for emitters or other illuminants.

Alternatively or additionally can the illuminating device also comprise illuminants integrated into the retaining arms preferentially in the form of point light sources, for example LEDs, which induce their emitted light via the narrow sides of the light panels into the light panel parts. In particular, on the floor of the nut-shaped retaining recesses of the mentioned retaining arms LEDs can be foreseen, which are positioned at the front of the view-panel parts placed into the retaining recesses and make the view-panel parts illuminate from the inside, so to speak.

BRIEF DESCRIPTION OF THE DRAWINGS

The invention is subsequently further explained on the basis of a preferred embodiment and drawings relating thereto. The drawings show.

DETAILED DESCRIPTION

Figure 5:
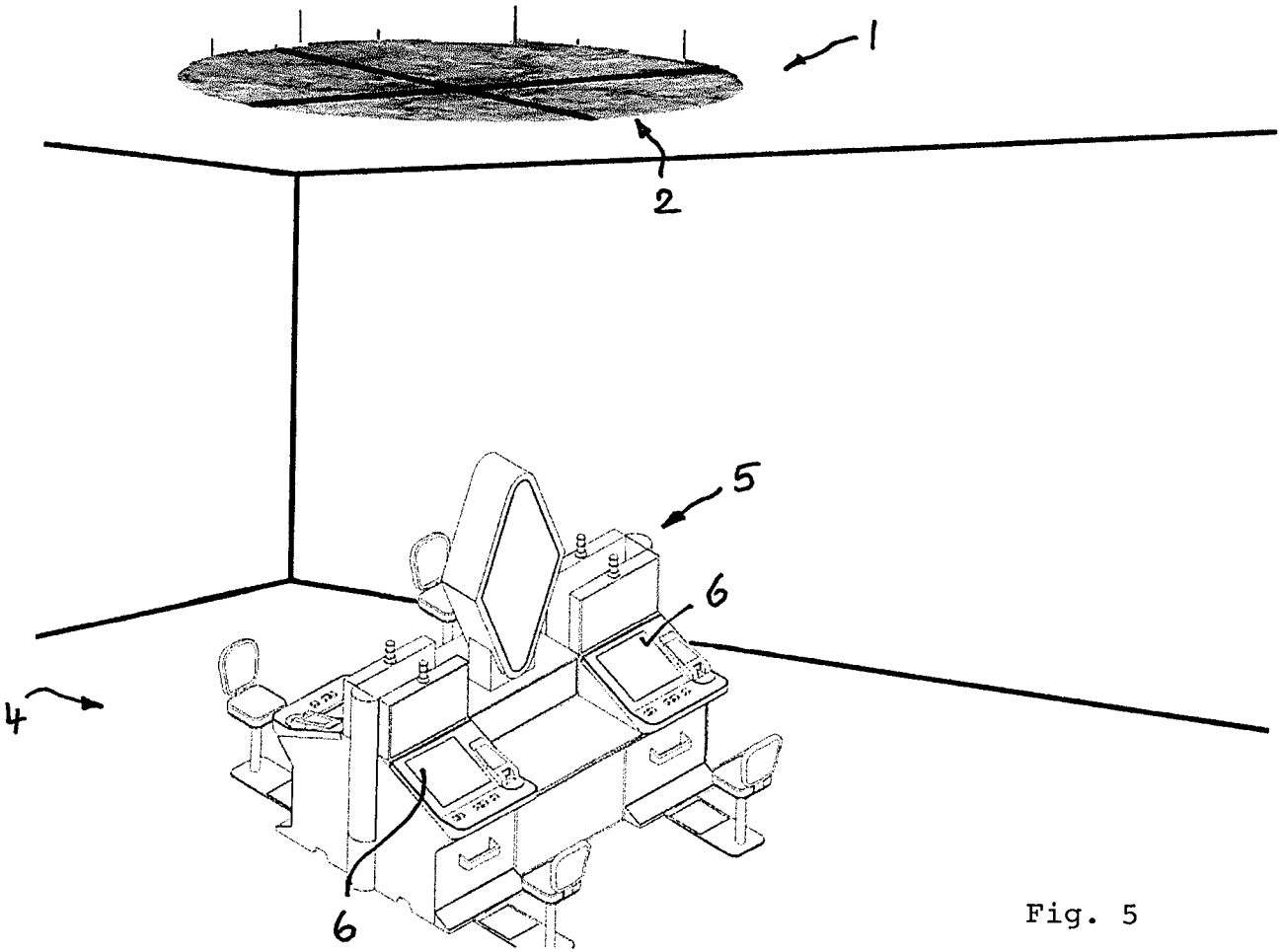
FIG. 5 is a schematic, perspective illustration of a gaming machine island, which is illuminated in an accentuated manner by an illuminating device mounted on the ceiling above the gaming machine island and its trans-illuminated view-panel illuminated in an accentuated manner.

The illuminating device 1 shown in the figures comprises an extensive view-panel 2, which consists of at least partly transparent material and is transilluminable, so that light emitted from the view-panel 2 illuminates a defined region of the room 4. As shown in FIG. 5, the illuminating device 1 can advantageously be used in a casino or gambling hall in order to there illuminate in particular a gaming machine island 5 where multiple gaming machines are combined. The view-panel 2 is in terms of its size advantageously adapted to the size of the gaming machine island 5, wherein in terms of its size a diameter of the view-panel 2 can correspond to the diameter of the gaming machine island, but depending on the size of the gaming machine island can also be dimensioned in a smaller or larger manner. Typically the view-panel 2 can have a diameter of one to five meters.

The view-panel 2 consists hereby advantageously of at least a partly transparent material, for example glass or a transparent plastic such a polycarbonate. However, alternatively or additionally view-panel parts can be foreseen to be out of a per se opaque material, which has a perforation or recesses, for example in the form of a perforated plate or a grid structure. Advantageously the view-panel can consist of transparent plastic disc pieces, which have a changing transparency or colour scheme, wherein sections of different transparency or different colour schemes can have merging transparency degree progressions or colour schemes, such as shown in FIG. 2.

In accordance with an embodiment the at least partly transparent material of the view-panel 2 can be laminated with a suitable film on one side and/or on both sides holohedrally or at least partly in order to facilitate further special light effects. Regarding the film it can be advantageously a transparent plastic carrier material with a photo emulsion, for example DURATRANS™ material or DURACLEAR™ material.

The view-panel is hereby advantageously approximately designed in a plate-shaped manner, in particular in an even manner. The view-panel can, however, have also a light bulbous, shell-like contouring.

Figure 1:
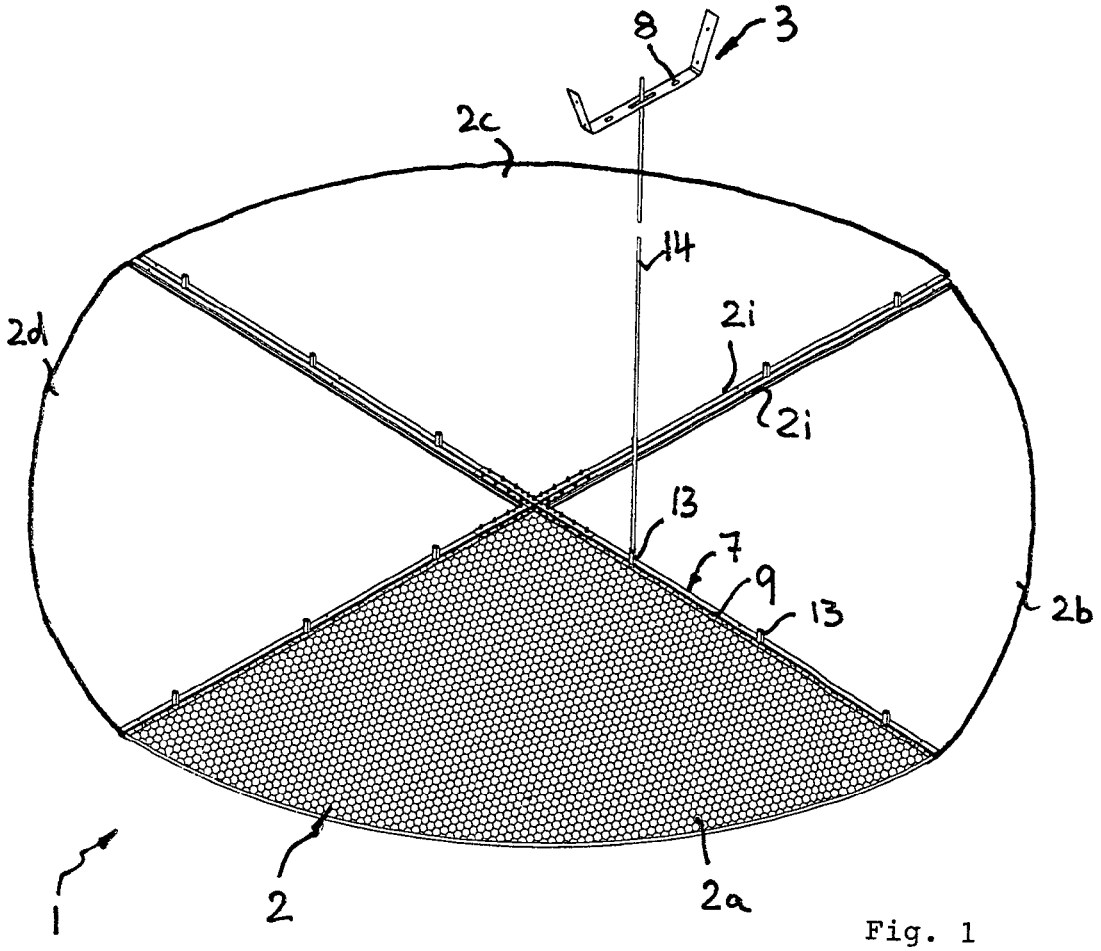
FIG. 1 is a perspective, schematic illustration of the illuminating device in accordance with an advantageous embodiment of the invention from a diagonally above point of view, which shows the non-visible side of the view-panel from the room to be illuminated and the panel retaining device.
Figure 2:
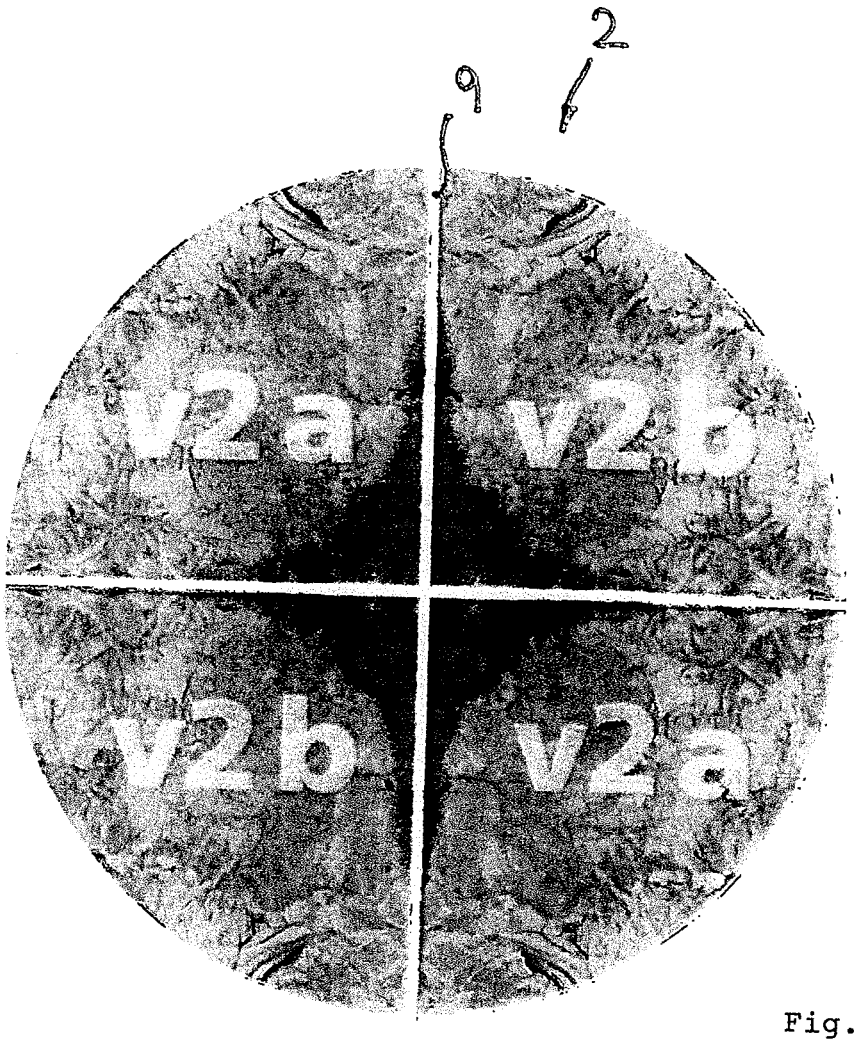
FIG. 2 is a top view of the visible side of the view-panel.
Figure 3:
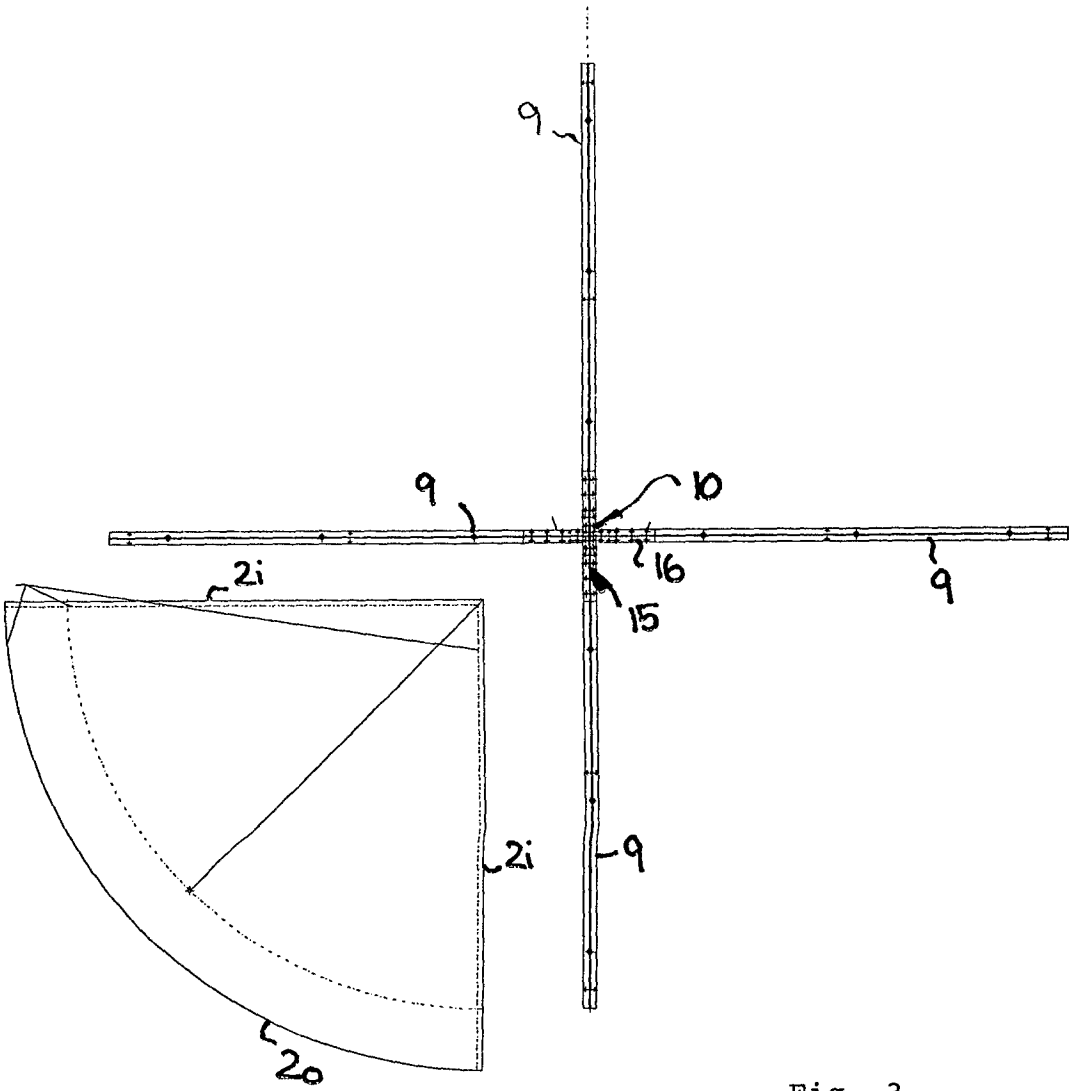
FIG. 3 is a top view of the retaining arms of the panel retaining device with a thereto attached view-panel part in explosion illustration.

As the FIGS. 1-3 show the view-panel 2 can be advantageously composed of various view-panel parts 2*a*, 2*b*, 2*c*, and 2*d*, which together form an approximately continuous view-panel surface. The view-panel parts are mutually form-adapted so that they complement each other in a puzzle piece-like manner to a continuous view-panel surface. Advantageously the view-panel 2 is hereby divided into view-panel parts congruent to each other, wherein the mentioned view-panel parts can advantageously form V-shaped contoured sector pieces. In the drawn embodiment the view-panel 2 hereby has a circular outer contour. However, it is understood that the view-panel 2 can also have an outer contour deviating from the circular form, for example in the form of a rectangle, in particular a square, but also other rounded contours such as ellipses or ovals, or other polygonal contours such as, for example, a hexagon. The view-panel parts 2*a*, 2*b*, 2*c* and 2*d* have hereby advantageously mutually congruent contoured side flanks, in particular in the form of V-shaped side flanks spread at the same angle. Also the outer contours 2*o* of the view-panel parts can be formed mutually congruent, wherein this can vary, however, i.e. the outer contours 2*o* can also be formed deviating from each other, for example if by external circumference an all in all oval or elliptic view-panel is to be formed.

The view-panel parts 2*a*, 2*b*, 2*c* and 2*d* are retained by a panel retaining device, which comprises the retaining arms 9 arranged in a star-shaped manner from a centre, which extend between the adjacent inner faces 2*i* of the view-panel parts 2*a*, 2*b*, 2*c* and 2*d*. As shown in FIGS. 1 and 3 the retaining arms 9 can be designed in the form of slim support bars, which enclose the view-panel parts 2*a*, 2*b*, 2*c* and 2*d* on the inner edge. Advantageously the mentioned retaining arms 9 have a straight course, wherein the retaining arms 9 advantageously run outwards under the same separation angles each radially from the centre of the view-panel 2.

As FIG. 3 shows the retaining arms 9 are connected inflexibly in the centre or in a central connection point 10 by a joint fastening element 15. The mentioned fastening element 15 can comprise cruciform or star-shaped protruding fastening bars 16, which are form-adapted to the retaining arms 9 and onto which the mentioned retaining arms 9 can be inflexibly fastened, for example can be screwed tightly or can be riveted. Alternatively or additionally between the retaining arms and the fastening element 15 a form-locked connection can be foreseen, for example in the form of a plug-in connection, which facilitates to plug the retaining arms 9 into the fastening bars 16 of the fastening element 15 or vice-versa to plug the fastening bars 16 into the retaining arms 9.

Figure 4:
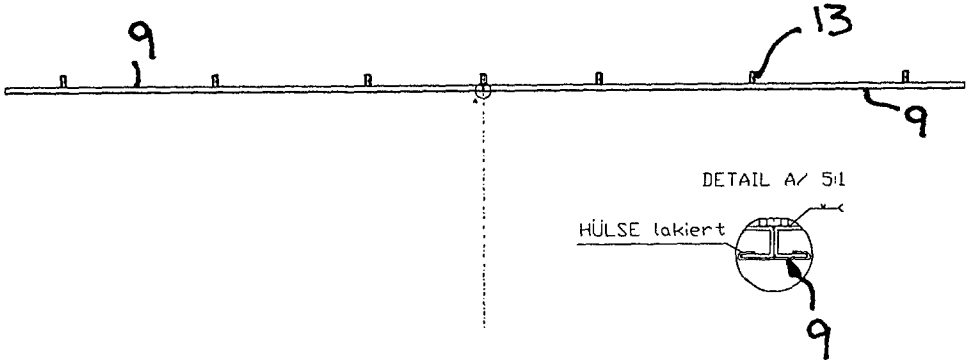
FIG. 4 is a lateral view of two retaining arms halves put together, wherein in a detailed view the cross-section form of the retaining arms is shown.

The retaining arms 9 are advantageously designed in the form of extruded profiles, which can have an H-shaped cross-section with towards the opposite side open retaining recesses 12. As shown in FIG. 4, there the detail A, the retaining recesses 12 can form continuous nut-shaped slots, which are delimited by two spaced apart, essentially parallel support bridges, between which the view-panel parts can be accurately fitting introduced or inserted into the elongated retaining recesses 12 of the H-shaped contoured retaining arms 9.

Alternatively the retaining arms 9 can be designed in the form of U-cross-section-shaped extruded profiles, wherein each two U-profiles are arranged back-to-back with open retaining recesses 12 towards the opposite lying side and connected with each other, for example, wielded, riveted and/or laminated. The retaining recesses 12 are adapted regarding the dimensioning to the thickness of the view-panel parts, in particular in such a manner that the view-panel parts 2*a*, 2*b*, 2*c* and 2*d* can be inserted easily or with a slight clamp fit.

Advantageously the retaining arms 9 are very narrow, designed in the form of long, thin bars, so that they separate the view-panel parts only minutely from each other. In the cross-section the retaining arms 9 can have a width which approximately corresponds to 100%-300% of the thickness of the view-panel parts.

The retaining arms 9 inflexibly mutually connected in the central connection point 10 carry on their upper side or lower side, which is on the far side of the view side of the view-panel 2, each a multitude of arranged fixing means 13 distributed in a grid manner, onto which tie rods 14 can be inflexibly fastened preferably in the form of bend-proof tie rods. As FIG. 1 shows the mentioned tie rods 14 can extend in general vertically to the level of the view-panel 2 away from the retaining arms 9. Depending on the existing connection dimensions, for example at a ceiling, the tie rods 14 can be fastened at different places on the retaining arms 9. The mentioned fixing means 13 can be, for example, screw bolts into which the tie rods 14 can be screwed in.

While FIG. 1 shows one tie rod 14, it is understood that multiple tie rods 14 can be foreseen to be distributed evenly across the view-panel 2 or the arrangement of the retaining arms 9.

I claim:

1. A view panel, comprising:

a translucent view-panel through which light can be transmitted;

a panel retaining device including a retaining means for the retention of the view-panel and a fixing means for mounting the view-panel on a fixed structure;

the retaining means includes at least three interconnected retaining arms which are arranged in the shape of a star;

the retaining means retains at least two view-panel parts at their adjoining inner faces so that the view-panel parts together form a substantially continuous view-panel surface, the view-panel parts have free outer faces, which are not retained by the retaining arms, and the outer faces together form the outer circumference of the view-panel.

2. The view-panel set forth in claim 1, wherein the retaining arms are contoured to form two neighbouring retaining arms and a view-panel sector having lateral sector edges contoured in an undercut-free manner to become narrow towards the connection point of the retaining arms.

3. The view-panel set forth in claim 1, wherein the retaining arms have a generally straight course to create V-shaped view-panel sectors.

4. The view-panel as set forth in claim 3, wherein the retaining arms have form-locked retaining elements;

the form-locked retaining elements include edges having retaining projections or retaining recesses, the edges attach to respective view-panel parts to form at least two lateral sides, wherein the view-panel parts are detachable from the retaining elements and are interchangeable with each other.

5. The view-panel as set forth in claim 4, wherein the retaining arms have a hollow cross-section with a nut-shaped periphery, the nut-shaped periphery defines opposing retaining recesses, the opposing retaining recesses enable two view-panel parts lying back-to-back to be inserted into the retaining recesses to hold the retaining arms.

6. The view-panel as set forth in claim 4, wherein the retaining arms have an H-shaped cross-section.

7. The view-panel as set forth in claim 4, wherein the retaining arms have a rear side that opposes the view side of the view-panel, the rear side includes a detachable fixing means including a stud bolt fastener means, for the fixing of tie rods.

8. The view panel as set forth in claim 1, wherein the panel retaining device comprises retaining poles inflexibly connectable to the retaining arms.

9. The view-panel as set forth in claim 1, wherein each retaining arm has a multitude of arranged fixing means distributed in a grid manner for the fixing of tie rods configured for mounting on a flat surface.

10. A view-panel, comprising:

a view-panel through which light can be transmitted; a panel retaining device, which includes a retaining means for the retention of the view-panel and a fixing means for mounting the view-panel;

the retaining means includes at least three interconnected retaining arms which are arranged in the shape of a star;

the retaining means retains at least two view-panel parts at their adjoining inner faces so that the view-panel parts together form a substantially continuous view-panel surface, the view-panel parts have free outer faces, which are not retained by the retaining arms;

the outer faces together form the outer circumference of the view-panel;

the retaining arms are interconnected by a joint cruciform fastening element;

the retaining arms inflexibly affix to the joint cruciform fastening element, and wherein the joint cruciform fastening element comprises radially arranged fixing bars, which conform to the retaining arms, to enable the retaining arms to press-fit with the fixing bars.

11. The view-panel as set forth in claim 10 further comprising: point light sources integrated in the retaining arms.

12. The view-panel as set forth in claim 10, wherein the view-panel parts form V-shaped sector pieces.

13. The view-panel as set forth in claim 10, wherein the view panel parts have a non-uniform transparency.

14. The view-panel as set forth in claim 10, wherein the view panel parts have a non-uniform colour scheme.

15. The view-panel as set forth in claim 10, wherein at least one of the view-panel parts comprises a range of transparency.

16. The view-panel as set forth in claim 10, wherein at least one of the view-panel parts comprises a range of colour.

17. A view-panel for a gaming machine island, comprising:

light-transmissive view-panels having inner faces;

a panel retaining device for adjoining the inner faces of the view-panels;

the panel retaining device includes at least three interconnected retaining arms and an illumination means including point light sources integrated in the retaining arms;

the panel retaining device retains the view-panels at their adjoining inner faces so that the view-panels together form a substantially continuous view-panel surface;

the view-panels have free outer faces, which are not retained by the retaining arms, and the outer faces form an outer circumference of the view-panel.

18. The view-panel as set forth in claim 17 further comprising a gaming machine island defining a diameter, wherein the outer circumference of the view-panel defines a diameter sized between 50% and 150% of the size of the gaming machine island diameter.

* * * * *